United States Patent [19]

Cade

[11] Patent Number: 4,895,269

[45] Date of Patent: Jan. 23, 1990

[54] PAINT BUCKET

[76] Inventor: Daniel W. Cade, 11140 Bayou Bernard Rd., Gulfport, Miss. 39503

[21] Appl. No.: 185,984

[22] Filed: Apr. 25, 1988

[51] Int. Cl.[4] ..... B65D 25/28

[52] U.S. Cl. ..... 220/90; 220/96

[58] Field of Search ..... 220/74, 90, 94 R, 96, 220/DIG. 5

[56] References Cited

U.S. PATENT DOCUMENTS

| | | | |
|---|---|---|---|
| 1,138,268 | 5/1915 | Westerbeck | 220/74 |
| 2,188,728 | 1/1940 | Spencer | 220/96 |
| 2,653,218 | 9/1953 | Schilling | 220/96 X |
| 3,081,906 | 3/1963 | Henchert | 220/74 X |
| 3,329,307 | 7/1967 | Jacobson | 220/90 |

FOREIGN PATENT DOCUMENTS

| | | | |
|---|---|---|---|
| 2136387 | 9/1984 | United Kingdom | 220/94 R |

*Primary Examiner*—Robert G. Nilson
*Attorney, Agent, or Firm*—Alexander F. Norcross

[57] ABSTRACT

A paint bucket, preferably cylindrical in shape, has a generally teardropped inner rim for decreasing sloshing and spillage of paint. Within one section of the inner rim is an inventive paint squeegee, of adjustable width, having a first fixed and a second removable side wiping section which may be adapted through a grooved, slideable adjustment to the width of any given paint brush. The squeegee further provides a horizontal face wiping section with a plurality of vertically arising teeth for removing excess paint from within the bristles of a brush. The bucket is provided with an adjustable, canted handle extending at an angle both over the top of the bucket and to one side so as to permit the bucket to be carried with minimum twisting force on the wrist of the user. An adjustable brush holder is shown for holding brushes of varying handle widths in a handle down, brush up position; such storage is practical because of the effectiveness of the squeegee in removing excess paint from the brush.

9 Claims, 2 Drawing Sheets

FIG.

PAINT BUCKET

BACKGROUND OF THE INVENTION

This invention relates to the field of paint buckets and containers for aiding in the painting with brushes.

Paint is applied as a coating to surfaces, by a number of methods, the oldest and most prevalent of which is by means of multi-bristled brushes. A brush serves two purposes in applying a uniform coating of paint to a surface. The first is that a brush carries a quantity of paint to coat a usable area of the surface in each application; the second is that the brush smoothes the paint to a uniform coat while the paint is still liquid and free flowing. The paint that is usefully applied is paint carried on the exterior of the brush, clinging there by the combination of friction and paint viscosity. The brush bristles provide a uniform, resilient means for smoothly wiping the paint as it flows from the surface of the brush to the applied surface. Paint which is not on the side of the brush adjacent this surface is wasted, as it is not applied.

Paint on the sides (the narrow edges of a brush) and on the back face comes from dipping the brush in paint; this paint is the principal source of splashes, drips and similar problems. Paint trapped within the bristles of the brush, stiffens the brush, making it less suitable for creating a uniform thin coat of paint. Such entrapped paint further creates irregularities in the application of paint as the deflection of the brush will tend to squeeze paint from the bristles in a highly non-uniform manner.

Numerous inventions have attempted to reduce such problems with paint brushes by providing a holder for the brush to minimize drips or by providing in one means or another for removing excess and undesired paint during the painting.

For instance, Canadian Pat. No. 576,809 to Waddell discloses a combined paint brush scraper and holder for installation over an open paint can. This holder, a transverse bar with clip for brush handle, is secured across a chord of the open paint can in such a manner that the brush is held over the paint, and a chordal edge of the scraper can be used for wiping excess paint from the brush.

U.S. Pat. No. 4,203,537 to McAllister discloses a removable accessory for use on a paint can with extended rim and lip so that a paint brush may be placed upon the rim and all paint will drip back into the paint can.

French Pat. No. 2,299,167 discloses a brush rest for installation across a semi-circumference or a portion of the interior face of a paint can; this brush rest contains a pattern of slots through which paint may drip and a surface upon which the wet paint brush may be placed.

U.S. Pat. No. 4,145,789 discloses a sheet to be inserted vertically within a paint bucket and containing holes for the release of paint, and against which a brush or a roller may be wiped to evenly distribute the paint on the brush.

U.S. Pat. No. 4,266,686 discloses a paint brush holder for installation on a can of paint which consists of a semi-circular segment having one or more clips on the upper surface for holding the handles of the paint brushes, which are thus suspended with the bristles over the open portion immediately above the paint in the paint can.

U.S. Pat. No. 4,101,046 discloses an angular paint brush holder mounted on the rim of a paint can so that a paint brush is held in an essentially vertical position. The paint will then run down from the base of the bristles toward the tip. This patent, as in the Canadian patent, provides that the flat edge of the cradle provides a linear surface for wiping the back face of the brush. It should be noted that this patent clearly depicts in FIG. 6 the disadvantages inherent in wiping a brush against the edge of a standard paint can which, of necessity, must contain at least one U-shaped channel for securing the lid.

U.S. Pat. No. 4,125,210 discloses a lid attachment for a paint can adapted for holding a paint brush.

British Pat. No. 971,869 discloses a spring loaded, clamp on brush holder for installation on the rim of a paint can. This holder holds the brush at a downward angle rather than horizontally, and in addition, provides a handle for the paint can.

British Pat. No. 177,983 shows an alternate form of a semicircular or segmented paint scraper and lid attachment.

SUMMARY OF THE INVENTION

One disadvantage of all prior art inventions described above is that they are single purpose attachments to a full distribution sized can of paint. Paint normally is distributed in cans of a one gallon size. Since paint is denser than water, a one gallon can will weigh well in excess of ten pounds, can weight included. The continual holding and manipulation of a ten pound weight in one hand, especially with a narrow handle, can produce muscle fatigue and cramping over a full eight hour working day.

Further, the paint within a one gallon paint can must be periodically stirred as the pigments tend to separate from the solvent base after passage of a period of time. The mere act of dipping a brush in the paint is not sufficient to maintain such a large volume of paint in a totally stirred state; more vigorous agitation is required. Since all paints dry and set by a process triggered by the evaporation of their solvent into the air, the exposure of a large volume of such paint to the air results ultimately in a skin over the top of the paint which interferes with the painting process; a gallon of paint is simply too large a quantity to maintain open to the air during the time required to apply all of it to a uniform surface.

The instant invention is therefore of a smaller, intermediate paint bucket which is sized to contain a reasonably useful quantity of paint for application, small enough for the paint to be continually agitated and maintained in a mixed state by the painting process, and not to be an undue weight burden for the painter, but large enough to give a suitable working time between refills.

The upper rim of the bucket is provided with an inwardly sloping surface forming a teardrop shaped cross section which has been found to significantly reduce drips, sloshing and the chance of spills as the bucket is carried in the process of painting.

The bucket is provided with a canted, enlarged handle to permit a more uniform and comfortable carrying of the bucket. The angle of the handle is adapted to the normal relaxed carrying posture of the human hand, by canting the handle both forward and to one side at an essentially 45 degree angle to the vertical so that the weight of the bucket is directly beneath the line of the wrist, reducing the holding effort. The handle preferably can be flipped from a position suited for left hand carrying to a position suited for right hand carrying, to fit the handedness of the user. The handle is molded to fit the fingers of the hand, decreasing slippage and hand strain from extended use.

On the rim of the bucket, opposite to the handle, is provided an innovative sliding gate brush scraper or squeegee containing a fixed first side scraping member, a horizontal face scraping member and a second, slideably adjustable side scraping member mounted in grooves along the paint bucket so as to allow the width of the paint scraper or "squeegee" to be adjusted to exactly fit the specific paint brush being used. Along the horizontal face scraper are a plurality of vertically extending triangular tooth members, of a length substantially equivalent to between one-half and ninety percent of the thickness of the expected brush.

In use, the brush is drawn horizontally through the bucket "squeegee", removing in a single pass substantially all the external paint on the lower face and both sides of the brush. The teeth members, rising into the bristles of the brush, remove a significant portion of the entrapped paint within the bristles, preserving the brush's flexibility. The teeth members also act as an end scraper which, by the action of the horizontal drawing of the brush, removes substantially all of the free paint from the bottom tip of the brush as the brush is drawn free.

It is therefore a purpose of the invention to provide a paint bucket having a significantly reduced susceptibility to sloshing and spills while being carried and in use.

It is a further object of this invention to show a paint bucket having a handle which significantly reduces the strain and effort of carrying the bucket during long term painting use.

It is a further object of this invention to provide a paint bucket having a significantly improved brush scraper or squeegee which removes substantially all unneeded paint from a paint brush.

It is a further object of this invention to show an innovative paint bucket which extends the useable life of a paint brush.

It is a further object of this invention to show a paint bucket having in combination, significantly improved carrying capability, imposing reduced hand strain upon the user; having significantly reduced susceptibility to sloshing and spillage; and having a paint scraper which substantially removes all unneeded paint from a paint brush, reducing the probability of drips and splatter.

It is a further object of this invention to show a paint brush squeegee which so substantially cleans a brush of excess free paint that the brush may be temporarily mounted for carrying in a bristle up position, and to show a universal holder for a brush in such a position.

BRIEF DESCRIPTION OF THE DRAWINGS

FIG. 12B is a cross section therethrough.

DETAILED DESCRIPTION OF THE PREFERRED EMBODIMENT

Figure 1:
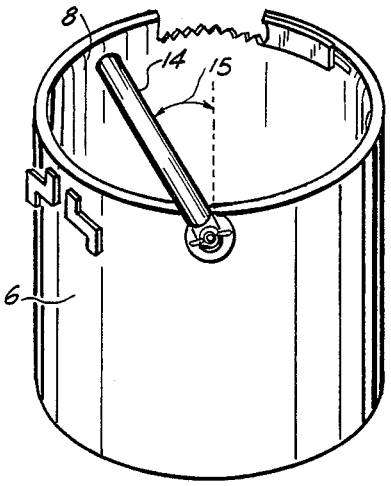
FIG. 1 is a view of the bucket of the invention.
Figure 9B:
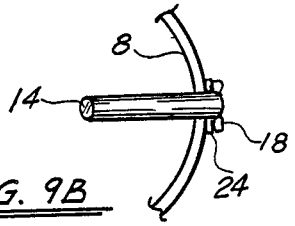
FIG. 9 is an exploded view of the handle of the inventive paint bucket.
FIG. 9A is a side view and FIG. 9B a top view of the handle of the invention as installed.
Figure 9A:
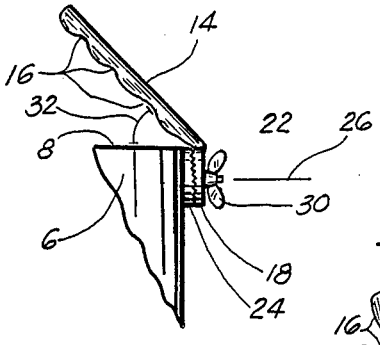
Figure 2:
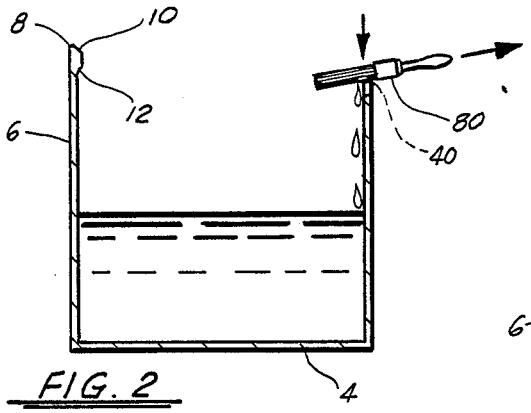
FIG. 2 is a cross view of the bucket showing the rim.
Figure 5:
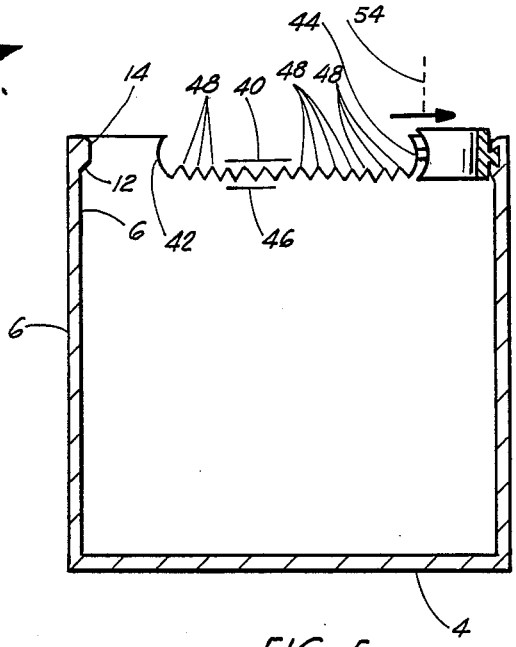
FIG. 5 is a sectional view of the bucket depicting the squeegee.
Figure 6:
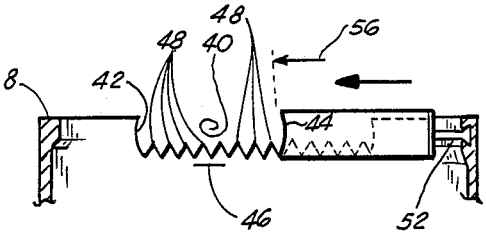
FIG. 6 is a portion of the sectional view showing the alternate position of the squeegee.

Referring to FIG. 1, inventive paint bucket 2 is shown in preferred form to be an essentially cylindrical bucket having a closed base 4 enclosed by vertical, cylindrical sidewalls 6. Sidewalls 6 terminate in teardrop rim edge 8, more clearly seen in cross section in FIG. 2 to be a smooth curving, inwardly extending rim which has no outwardly sloping component. The upper edge of the rim is a relatively short radius curve 10 smoothly flared into a lower section long radius curve 12.

The existence of short radius curve 10 provides that all paint spilled on or touching the rim of paint bucket 2 flows back to the inside of the bucket, and that none is trapped on the rim, nor does it flow to the outside of the bucket. Long radius lower section 12 provides a gentle inward slope to the upper section of sidewall 6, which tends to divert sloshing as the bucket is moved and significantly reduces spillage.

Figure 3:
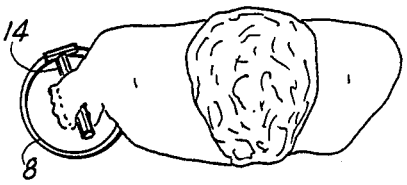
FIG. 3 is a top view showing the position of carrying the bucket.
Figure 9:
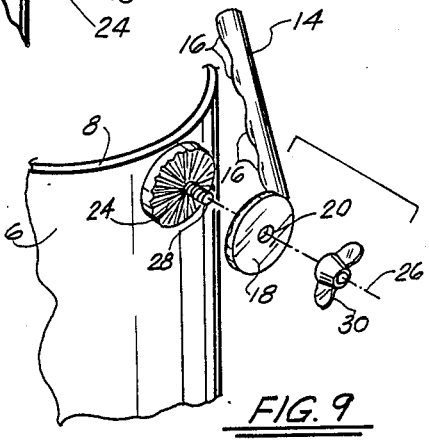
Figure 12A:
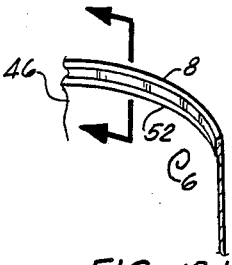
FIG. 12A is a view of a section of the bucket showing the mating tongue and groove for the sliding section.
Figure 11A:
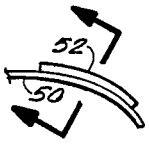
FIG. 11A is top view of the sliding squeegee section and FIG. 11B a cross section therethrough.
Figure 10:
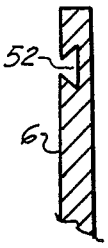
FIG. 10 is a view of the sliding squeegee section.
Figure 10:
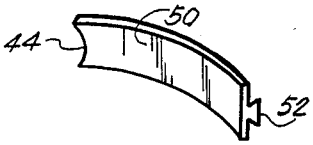
Figure 11B:
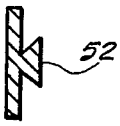
Figure 4:
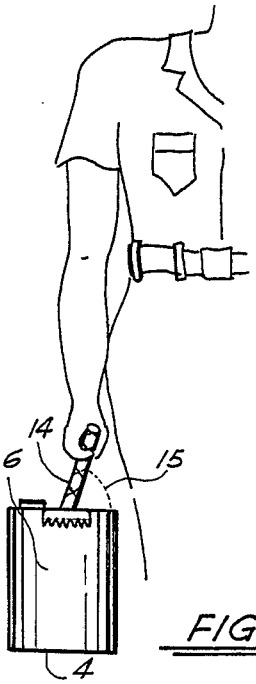
FIG. 4 is a frontal view showing the position of carrying of the bucket.

FIGS. 3 and 4 depict the method of holding the bucket through handle 14. Handle 14 is an essentially thick cylindrical handle mount having finger grip curves 16, adapted to provide for a smooth distribution of weight along the closed hand while reducing slippage of the handle from the hand.

Handle 14 at a lower section is connected to angled base member 18, a circular cross section member having a central fastening hole 20 from which radially extends zigzag connection face 22.

Connection face 22 interlocks with a zigzag receiving mount 24 located at handle mounting point 26 on an upper, outer portion of sidewall 6. A screw member 28 extends outward from handle mounting point 26, perpendicular to sidewall 6 and mates cooperatively with wing nut 30 to fasten handle face 18 to the bucket. When wing nut 30 is tightened, the cooperating relationship of zigzag face 22 and receiving zigzag mount 24 lock handle 14 in a lateral angular position 15 with respect to the bucket 2.

Handle 14 is mounted at an inward angle 32 to base member 18; this angle is typically 45 degrees, causing handle 14 to extend in a covering position over the top of the bucket 2 offset laterally by angle 15. Thus, as shown in FIGS. 3 and 4, when a painter holds handle 14 in a natural, wrist relaxed position, bucket 2 hangs directly in line with and beneath the wrist.

The position of the handle mounting point 26 defines the back of the bucket. Located essentially on the front of the bucket, along rim 8 is horizontally mounted squeegee 40. Squeegee 40 is constructed of a horizontal opening in sidewall 6 along rim edge 8; this opening is bounded by first side scraper edge 42 and second side scraper edge 44 extending down and forming the ends of brush face scraping edge 46, parallel to but indented down from rim edge 8. Vertically arising from brush scraping edge 46 are brush teeth 48, which typically are a plurality of side by side triangular teeth members extending upward from face scraping edge 46.

The width of squeegee 40 may be varied to match a chosen paint brush by mounting second side scraper edge 44 on sliding squeegee section 50. Sliding section 50 is mounted in sidewall 6 by means of a tongue and groove fastening 52, and is curved radially to match the curvature of sidewalls 6 so that squeegee section 50 may be slid from a first relatively open position 54 to a second relatively narrow position 56. This permits the width of squeegee 40 to be variably set at any width between two extreme positions, matching the size of a chosen paint brush.

Figure 7A:
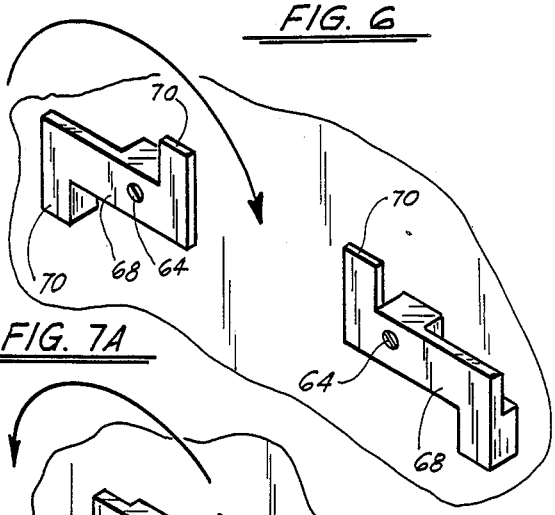
FIG. 7A and 7B depict the brush holder of the invention.
Figure 8A:
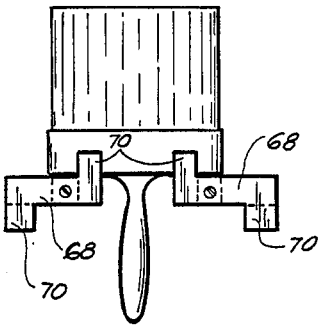
FIG. 8A and 8B depict two different positions of the brush holder encompassing the brush.
Figure 7B:
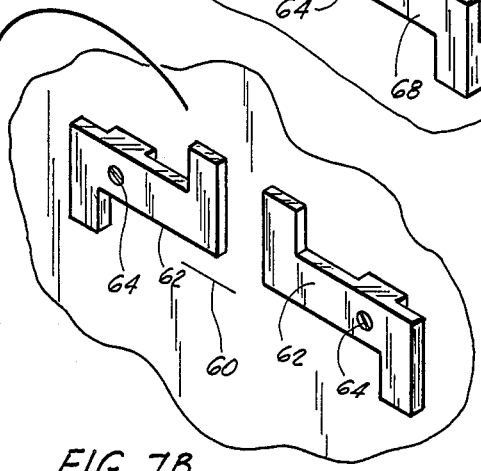
Figure 8B:
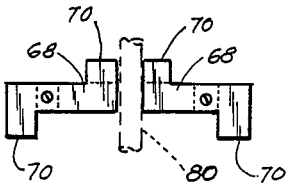

For convenience of use, bucket 2 is additionally provided with an adaptable brush holder 60 as shown in FIG. 7. Brush holder 60 comprises a Z-shaped brush gripper bar 62 mounted pivotally to sidewall 60 through a pivot point 64; pivot point 64 is offset along the length of gripper bar 62 so that when gripper bar 62 is rotated about its pivot point, it may be rotated from a first position having a short inward extension to a second inward extension. This creates either a relatively wide brush handle space 66 or a relatively narrow brush handle space 66 between two adjacent brush gripper bars 62. Gripper bar 62 is of a Z-shape, comprising a central pivoting bar section 68, at the extreme ends of which are oppositely mounted first and second brush retainer bars 70. Each of the brush retainer bars 70 is offset mounted at the ends of on the central pivoting bar 68 so as to define a space between the retainer bars and sidewall 6 in which the wide, bristle retaining portion of a paint brush 80 will fit.

Brush holder 60 may have either two pivoting gripper bars 62 as shown in FIG. 7 or, for simplicity of construction, a fixed horizontal bar member 68A with a vertically extending, offset brush retainer bar 70A may be provided opposite a single rotating brush gripper bar 62.

For either form of brush holder 60, brush 80 may be mounted, handle down, on bucket 2 by rotating brush gripper bar 62 until the distance between the central pivoting bar 68 is appropriate to the width of the handle of the paint brush; the paint brush handle then may be placed between opposing bars 68 and moved downwards, securing the handle between the opposing pivoting bars. The brush retainer bars 70 enclose the bristle retaining portion of brush 80 against the sidewall 6 of the bucket.

In use, bucket 2 is adapted to being carried by either a left handed or a right handed painter by the adjustment of handle 14 so that handle 14 is laterally angled either to the left or to the right of bucket 2. Handle 14 then secured by tightening wing nut 30, interlocking zigzag faces 22, 24, preventing slippage of the handle. A left handed painter, for example, would then hold the bucket in his right hand, painting with his left hand; the bucket, being filled with paint, resists sloshing during movement because of the inward extending teardrop rim edge 8.

After paint brush 80 is dipped in the paint it is then drawn horizontally through squeegee 40. Since sliding section 50 will have been set so that squeegee 40 is exactly the width of the paint brush, simultaneously first side scraper edge 42, second side scraper edge 44, and face scraping edge 46 remove substantially all the loaded paint from one face and both sides of the brush, leaving only the top face loaded with paint. Of equal importance, brush teeth 48 extend into the bristles removing a substantial quantity of the paint otherwise trapped within the bristles. The natural wiping action of teeth 48, as the brush 80 is pulled through the squeegee further removes substantially all of the paint from the brush tip end.

The brush may then be readily used for painting, having paint upon only one face, being substantially free of drips or splatters because of the removal of excess paint from the sides, the bottom face, and from within the bristles. The removal of the paint from within the bristles further maintains the brush in a more flexible state, enhancing its effectiveness, life and durability.

Squeegee 40 is sufficiently effective in removing excess paint from the brush that when the brush is to be held for a period of non-use, it may be wiped twice through the squeegee, face up and face down. This double wipe is removes the paint from the exterior and the bristles of the brush, so that the brush may then be mounted bristles up and handle down in brush holder 60 without risk of paint drippage or flow down the handle.

As a result, the brush need not, contrary to the prior art, be mounted in a horizontal position with the handle sticking out, with the attendant risk of inadvertent knocking or tipping over of the brush and paint bucket combination.

By shaping handle 14 with finger grips so as to resist slippage and by mounting handle 14 at the angles above described, both offset laterally and vertically, a natural carrying posture is achieved where the weight of the bucket is suspended directly beneath and in line straight wrist of the user. This position largely eliminates twisting strain on the wrist, and is the most relaxed posture for long term carrying of the paint bucket during usage. The handle of the instant invention therefore significantly reduces fatigue in the wearer during full time painting.

It can thus be seen that the invention here claimed extends not only to the combination bucket taken as a whole, but separately to the form and arrangement of the handle for reducing fatigue in a liquid container which must be held or carried for a long time or to the form of the squeegee which is considered innovative and more effective in removing unwanted paint from a paint brush during the course of painting than prior art paint scrapers.

It can thus be seen that the invention is not restricted to the specific embodiment described above but to that wider range of equivalents which are claimed, and in particular to squeegees of equivalent structure and function which may be provided as sub-assemblies for mounting upon a bucket rather than being molded in. It should also be apparent that the bucket need not be cylindrical, but may be of any convenient shape.

I claim:

1. A paint bucket comprising:

(a) a bucket having a closed planar bottom;

(b) enclosed sidewalls arising vertically from the bottom defining an interior space for containing a material;

(c) said sidewall terminating in an upper rim;

(d) handle means affixed to a point on said sidewall, proximate said rim, said handle means being canted at a substantial angle from the point of attachment in a direction across said interior space;

(e) said handle means being additionally canted at a substantial angle sideways with respect to a vertical axis of said bucket.

(f) said bucket rim further comprising:

(g) a downwards, inwardly, smoothly curving interior tear drop shape having a first, shorter radius inwardly curving upper section smoothly adjoining a second longer radius outward curving lower section.

2. A paint bucket comprising:

a. an enclosed container having a substantially planar base with enclosing sidewalls arising vertically therefrom, defining a vertical axis thereof;

b. said sidewalls terminating in an upper rim distal of said bottom section;

c. squeegee means mounted vertically within an arcuate section of said rim, said squeegee means further comprising;

d. a first, vertically descending side brush scraper edge, extending from said rim downwards to a lower point within said sidewalls;

e. a horizontal brush face scraper edge, extending horizontally within said sidewall from said first point to a second point;

f. second brush side scraper edge extending vertically from said second point to said second rim; and g. a plurality of teeth means arising from said face scraper edge intermediate said rim.

3. A bucket as described in claim 2 above wherein said second face means further comprises:

a. a removable, semi-cylindrical arcuate section slideably affixed within said sidewall adjacent said squeegee, affixed for relative lateral movement horizontally along said rim;

b. said section defining said second brush side scraping edge;

c. said section being slideable radially between a first position relatively close to first side scraping edge and a second position relatively distant from said first side scraping edge.

4. A bucket as described in claim 3 above wherein said rim further comprises:

a. a downwards, inwardly, smoothly curving interior tear drop shape having a first, shorter radius inwardly curving upper section smoothly adjoining a second longer radius outward curving lower section.

5. A paint bucket, comprising:

a. a bucket having a closed planar bottom;

b. enclosed sidewalls arising vertically from the bottom defining an interior space for containing a material;

c. said sidewall terminating in an upper rim;

d. handle means affixed to a point on said sidewall, proximate said rim, said handle means being canted at a substantial angle from the point of attachment across said rim, over said interior space;

e. said handle being additionally canted at a substantial angle sideways with respect to a vertical axis of said bucket;

f. squeegee means mounted vertically within an arcuate section of said rim, said squeegee means further comprising;

g. a first, vertically descending side brush scraper edge, extending from said rim downwards to a lower point within said sidewalls;

h. a horizontal brush face scraper edge, extending horizontally within said sidewall from said first point to a second point;

i. second brush side scraper edge extending vertically from said second point to said second rim; and j. a plurality of teeth means arising vertically from said face scraper edge, intermediate said rim.

6. A bucket as described in claim 5 said rim further comprising:

a. a downwards, inwardly, smoothly curving interior tear drop shape having a first, shorter radius inwardly curving upper section smoothly adjoining a second longer radius outward curving lower section.

7. A bucket as described in claim 6 above further comprising:

a. a removable, semi-cylindrical arcuate section slideably affixed within said sidewall adjacent said squeegee, affixed for relative lateral movement horizontally along said rim;

b. said section defining said second brush side scraping edge;

c. said section being slideable radially between a first position relatively close to first side scraping edge and a second position relatively distant from said side scraping edge.

8. A bucket as described in claim 5 further comprising:

a. a removable, semi-cylindrical arcuate section slideably affixed within said sidewall adjacent said squeegee, affixed for relative lateral movement horizontally along said rim;

b. said section defining said second brush side scraping edge;

c. said section being slideable radially between a first position relatively close to first side scraping edge and a second position relatively distant from said side scraping edge.

9. A bucket as described in claim 5 further comprising:

a. an adjustable paint brush holder means comprising:

i. a first horizontal bar member mounted at a first point exterior of said sidewall;

ii. a first vertical brush retainer bar fixed to an end to said first bar, vertically arising, spaced outwardly from said sidewall;

iii. a second brush handle bar pivotally affixed to said sidewall horizontally spaced from said first bar, rotatable from a position adjacent said first bar to a second position more distant from said first bar;

iv. second vertically arising a brush retainer bar particularly affixed to the end of said pivoting bar, spaced from said sidewall.

* * * * *